US005512706A

United States Patent [19]

Kondo

[11] Patent Number: 5,512,706

[45] Date of Patent: Apr. 30, 1996

[54] AUTOMATIC ACCOMPANIMENT DEVICE HAVING A FILL-IN REPEAT FUNCTION

[75] Inventor: Masao Kondo, Hamamatsu, Japan

[73] Assignee: Yamaha Corporation, Japan

[21] Appl. No.: 326,706

[22] Filed: Oct. 20, 1994

[30] Foreign Application Priority Data

Oct. 25, 1993 [JP] Japan ..... 5-288748

[51] Int. Cl.[6] ..... G10H 1/36; G10H 1/38; G10H 1/40

[52] U.S. Cl. ..... 84/634; 84/635; 84/637; 84/DIG. 12; 84/DIG. 22

[58] Field of Search ..... 84/609–614, 634–638, 84/DIG. 12, DIG. 22

[56] References Cited

U.S. PATENT DOCUMENTS 4,628,788 12/1986 Shibukawa .

*Primary Examiner*—Stanley J. Witkowski
*Attorney, Agent, or Firm*—Graham & James

[57] ABSTRACT

While automatic accompaniment for chord, bass, rhythm etc. is performed in accordance with a normal pattern, the normal pattern is changed over to a fill-in pattern in response to actuation of a fill-in switch. Then, automatic accompaniment based on the fill-in pattern is repetitively performed as long as the fill-in switch is actuated. When the end of the fill-in pattern is detected, repeat control of the fill-in pattern causes the fill-in pattern to be repeated from a predetermined intermediate point (for example, the head of a predetermined intermediate measure of the fill-in pattern). As the result, the introductory portion of the fill-in pattern is performed only once so that it is never performed during repetition of the fill-in pattern. This can avoid undesirable musical unnaturalness due to repetition of the introductory portion.

6 Claims, 4 Drawing Sheets

AUTOMATIC ACCOMPANIMENT DEVICE HAVING A FILL-IN REPEAT FUNCTION

BACKGROUND OF THE INVENTION

The present invention relates generally to automatic accompaniment devices having a fill-in function, and more particularly to such an automatic accompaniment device which is provided with a fill-in repeat function for allowing a specific fill-in pattern to be repetitively performed in response to continued actuation of a fill-in switch and which is so improved as to effectively avoid undesirable musical unnaturalness in repeating the fill-in pattern.

Such automatic accompaniment devices for chord, bass, rhythm etc. are conventionally known which, in response to continued actuation of a predetermined fill-in switch, repeat an automatic accompaniment performance by, upon arrival at the end of a fill-in pattern, returning to the head of a first measure of the pattern (see U.S. Pat. No. 4,628,788, for example).

However, the above-mentioned prior automatic accompaniment devices are designed to always repeat a fill-in pattern from the beginning of the pattern and thus would cause undesirable musical unnaturalness. Because, each fill-in pattern is normally composed of an introductory portion and a pattern portion following the introductory portion, and when repeating a fill-in pattern, the introductory portion of the pattern is repetitively performed, thus unavoidably resulting in musical unnaturalness.

SUMMARY OF THE INVENTION

It is therefore an object of the present invention to provide an improved, novel automatic accompaniment device which can effectively avoid undesirable musical unnaturalness in repeating a fill-in pattern.

In order to achieve the above-mentioned object, the present invention provides an automatic accompaniment device which comprises a storage section for storing a normal accompaniment pattern and a fill-in accompaniment pattern, an operator for instructing an automatic accompaniment based on the fill-in accompaniment pattern, an automatic accompaniment section for performing an automatic accompaniment based on one of the normal and fill-in accompaniment patterns, the automatic accompaniment section, in response to actuation of the operator during the automatic accompaniment based on the normal accompaniment pattern, changing the automatic accompaniment over to the automatic accompaniment based on the fill-in accompaniment pattern, an end detection section for detecting an end of the automatic accompaniment based on the fill-in accompaniment pattern, and a control section for, when the end of the automatic accompaniment based on the fill-in accompaniment pattern is detected by the end detection section, performing control such that the automatic accompaniment based on the fill-in accompaniment pattern is repeated from an intermediate portion thereof if the operator is being actuated and that the automatic accompaniment based on the fill-in accompaniment pattern is changed over to the automatic accompaniment based on the normal accompaniment pattern if the operator is not being actuated.

According to the present invention thus arranged, when repetition of the automatic accompaniment based on the fill-in accompaniment pattern is instructed by the operator, the automatic accompaniment is repeated from an intermediate portion of the fill-in accompaniment pattern, so that repetitive performance of the introductory portion of the fill-in accompaniment pattern is avoided. Thus, it is possible to prevent musical unnaturalness in repeating the fill-in pattern.

The automatic accompaniment pattern repeat control of the present invention is applicable not only to the fill-in accompaniment patterns but also to other special patterns such as introductory patterns.

Now, the preferred embodiment of the present invention will be described in detail below with reference to the accompanying drawings.

DETAILED DESCRIPTION OF THE PREFERRED EMBODIMENT

Figure 1:
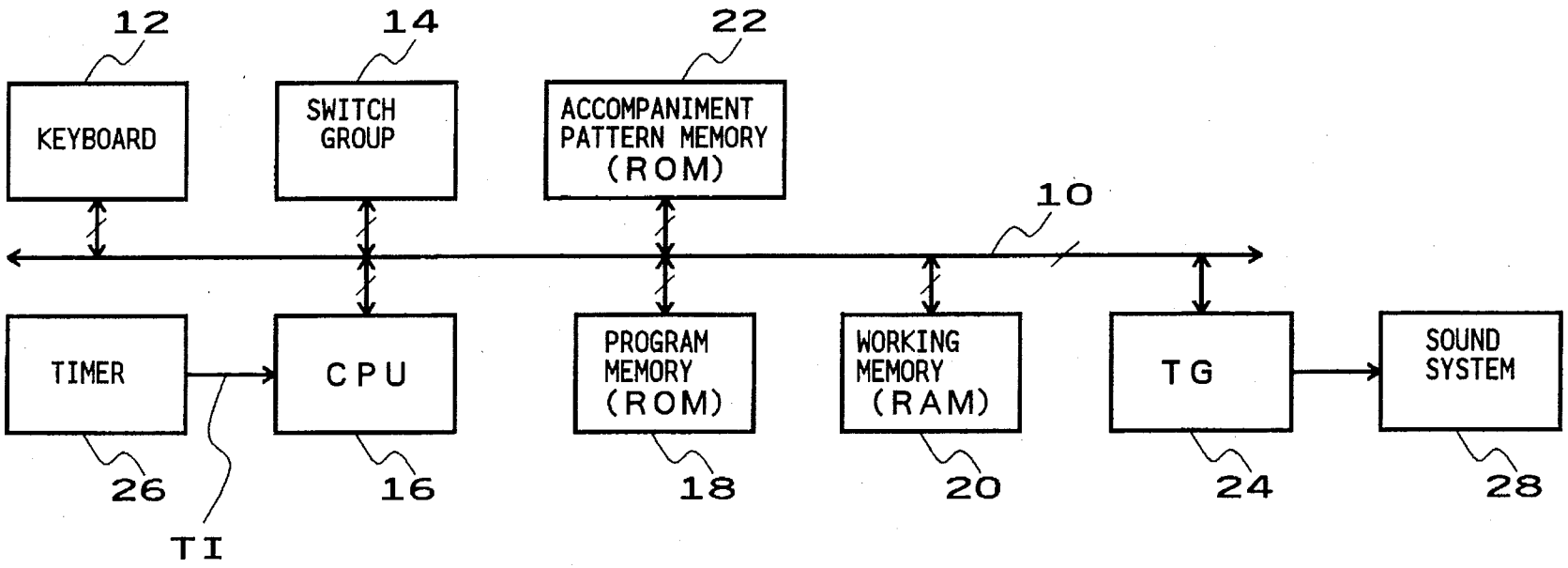
FIG. 1 is a block diagram illustrating a circuitry structure in accordance with an embodiment of the present invention.

FIG. 1 is a block diagram of an automatic accompaniment device in accordance with an embodiment of the present invention. This accompaniment device is so designed that generation of accompaniment tones for the chord, bass and rhythm parts is control led by a microcomputer. In FIG. 1 , each signal line with a tick drawn therethrough represents a multi-bit signal line.

To a bus 10 are connected a keyboard 12, a group of switches 14, a CPU (central processing unit) 16, a program memory 18, a working memory 20, an accompaniment pattern memory 22, a tone generator (TG) 24 etc.

The keyboard 12 has a multiplicity of keys, of which the keys in the right-hand side key area are used for melody performance and the keys in the left-hand side key area are used for chord designation. From the keyboard 12, key operation information can be detected by, for example, scanning key switches provided in corresponding relation to the keys.

The switch group 14 includes various switches provided on an operation panel in such a manner that operation information for each of the switches can be detected. The principal switches directly used for practicing the present invention are as follows:

(1) Style Selection Switches: These are switches for selecting any of plural accompaniment styles such as waltz;

(2) Start/Stop Switch: Switch for instructing a start or stop of an automatic accompaniment performance; and (3) Fill-in Switch: Switch for instructing that an accompaniment pattern should be changed from a normal pattern to a fill-in pattern.

The CPU 16 carries out various processing for generation of accompaniment tones in accordance with programs prestored in the program memory 18 comprising a ROM (read-only memory), as will be described in detail with reference to FIGS. 2 to 4. To the CPU 16 are supplied tempo interrupt signals TI which are generated at a frequency corresponding to a ninety-sixth note within a measure.

The working memory 20 comprises a RAM (random access memory) and contains storage areas which will be used as registers and counters as the CPU 16 performs various processing. The registers and counters associated with the practicing of the present invention will be explained later.

The accompaniment pattern memory 22 comprises a ROM which prestores, for each accompaniment style, accompaniment patterns for the three parts, i.e., cord, bass and rhythm parts. The accompaniment pattern for each of the parts are composed of a normal pattern for plural measures and a fill-in pattern for, say, two measures.

The tone generator 24 has a melody tone generation channel and also has, as accompaniment tone channels, zeroth, first and second channels for generation of chords and a fourth channel for generation of rhythm tones. Respective tone signals from the above-mentioned channels are fed to a sound system 28 where they are audibly reproduced or sounded.

Of the registers and counters provided within the working memory 20, the following are the principal ones associated with the practicing of the present invention:

(1) Chord Register CHD: In this register are stored chord data indicative of the root and type (e.g., C minor) of a chord obtained by chord detection processing.

(2) Style Number Register STYLE: In this register is set the number of an accompaniment style selected by means of the style selection switch.

(3) Run Flag RUN: This is a one-bit register which indicates by a value of "1" that an automatic accompaniment performance is in progress and indicates by a value of "0" that any automatic accompaniment performance is not in progress.

(4) Address Pointers $ADPNT_0$ to $ADPNT_4$: These registers point to respective addresses of accompaniment patterns for the zeroth to fourth parts and will be denoted hereinbelow by reference character $ADPNT_{0-4}$ when they are referred to collectively. In this embodiment, the accompaniment patterns for the zeroth, first and second parts are chord accompaniment patterns stored in the memory 22, accompaniment patterns for the third part are bass accompaniment patterns in the memory 22, and accompaniment patterns for the fourth part are rhythm accompaniment patterns in the memory 22.

(5) Mode Register MOP: In this register is set any of values "0", "1" and "2", the value "0" representing that the current operation mode of the device is a normal mode, the value "1" a fill-in standby mode, the value "2" a fill-in mode.

(6) Tempo Counter TCNT: This counter is incremented by one count each time the tempo interrupt signal TI is generated from a counter 26. The counter takes on count ranging from "0" to "96" and is reset upon arrival at "96" in the case of quadruple time, and it takes on a count ranging from "0" to "72" and is reset upon arrival at "72" in the case of triple time.

(7) Part Number Register PART: In this register is set any of part numbers 0 to 4. In the description given below, a representation $ADPNT_{PART}$ which is employed in relation to the address pointers signifies any one of the pointers which is designated by a specific part number set in this register PART.

(8) Key Code Register KC: In this register are set key code data contained in key-on data of the zeroth to third accompaniment patterns. Each key code data indicates any of predetermined key codes corresponding to plural tone pitches.

(9) Tone Generation Data Register DATA: For the zeroth to third accompaniment patterns, key code data having undergone tone pitch conversion processing is set in this register, while for the fourth accompaniment pattern, percussive musical instrument data is set in this register. The percussive musical instrument data indicates any of predetermined percussive musical instrument data corresponding to plural percussive musical instruments.

Figure 2:
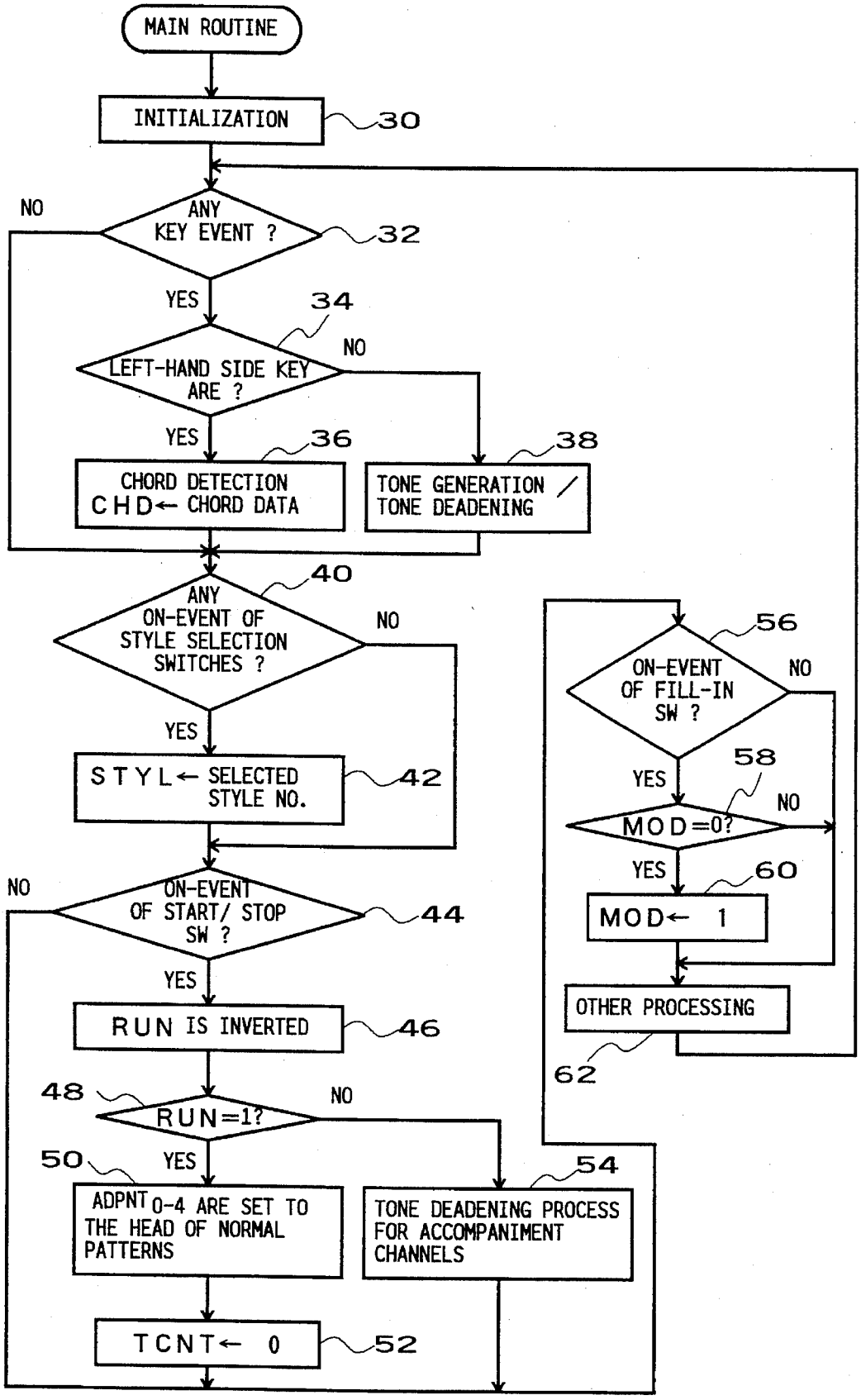
FIG. 2 is a flowchart of a main routine performed in the embodiment.

FIG. 2 shows a processing flow of a main routine carried out by the CPU 16. In step 30, a predetermined initialization process is performed to set the registers to respective predetermined initial states.

Then, in step 32, a determination is made as to whether there has occurred any key event (key-on or key-off event) on the keyboard 12. If the answer is in the step 34 to affirmative (YES), then the routine goes to further determine whether the key event has occurred in the left-hand side key area on the keyboard 12. If the determination of step 34 is in the affirmative, the routine further goes to step 36 to perform a chord detection process, where the root and type of a chord is detected on the basis of the key depression state in the left-hand side key area, and chord data indicative of the detected chord root and type are set into the chord register CHD.

If, on the other hand, the determination of step 34 is in the negative (NO), this means that the key event has occurred in the right-hand side key area on the keyboard 12, and the routine branches to step 38. In step 38, for the melody tone generation channel, a tone generation process is performed if the key event is a key-on event, whereas a tone deadening process is performed if the key event is a key-off event. As a result, generation of a melody tone becomes possible.

If the determination of step 32 is in the negative, or when the operation of step 36 or 38 has been terminated, the routine goes to step 40, where it is determined whether there has occurred any on-event of the style selection switches. If answered in the affirmative, the routine goes to step 42 to set the style number of the selected style into the style number register STYLE.

If answered in the negative in step 40, or when the operation of step 42 has been terminated, the routine goes to step 44 to determine whether there has occurred on-event of the start/stop switch. Upon a determination of YES, the routine goes to step 46 to invert the content of the run flag RUN, i.e., change the content to "0" if it is currently at a value of "1" or change the content to 1 if it is currently at value of "0". After that, the routine goes to step 48 to determine whether the run flag RUN is at "1". If the determination of step 48 is in the affirmative, the routine goes to step 50.

In step 50, the contents of the address pointers $ADPNT_{0-4}$ are set to the head of the normal patterns of such accompaniment patterns that are designated by the style number set in the register STYLE. Then, the routine moves further to step 52 to set "0" into the tempo counter TCNT.

If, on the other hand, the determination in step 48 is in the negative, the routine branches to step 54 in order to perform a tone deadening process for each of the zeroth to fourth accompaniment channels in the tone generator 24. This terminates an automatic accompaniment having been performed so far.

If the determination of step 44 is NO, or when the operation of step 52 or 54 has been terminated, the routine enters step 56, where a determination is made as to whether there has occurred an on-event of the fill-in switch. Upon a determination of YES in step 56, the routine goes to step 58 in order to determine whether the mode register MOD is at a value of "0" (indicating the normal mode). If answered in the affirmative in step 58, the routine goes to step 60 to set a value of "1" (indicating the fill-in standby mode) into the mode register MOP.

If the determination of step 56 or 58 is in the negative, or when the operation of step 60 has been terminated, other processing is performed in step 62. After step 62, the routine reverts to step 32 to repeat the operations this and succeeding steps in the above-mentioned manner.

Figure 3:
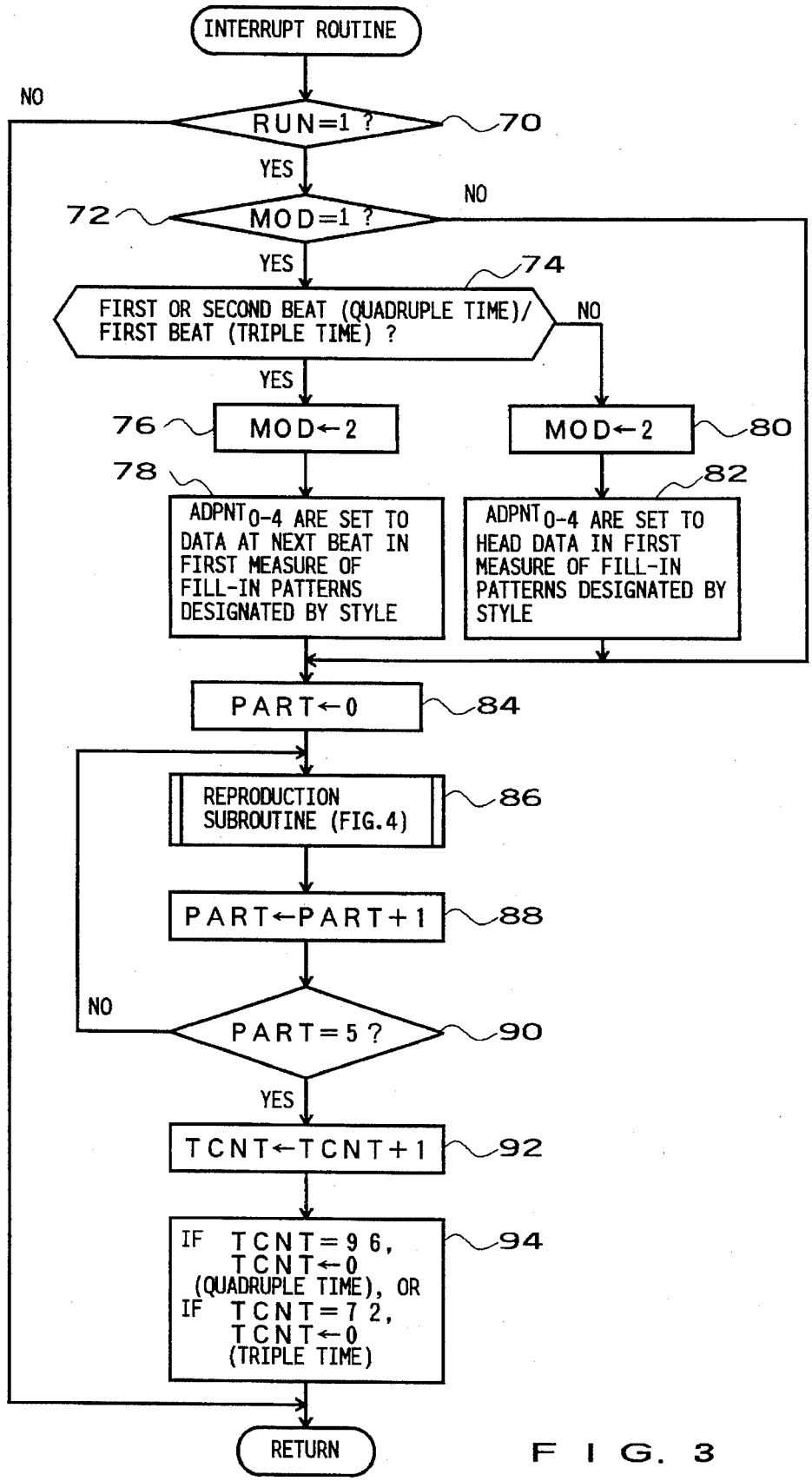
FIG. 3 is a flowchart of an interrupt routine performed in the embodiment.

FIG. 3 shows a step sequence of an interrupt routine carried out by the CPU 16. This routine is triggered each time the tempo interrupt signal TI is generated from the timer 26. In step 70, a determination is made as to whether the run flag RUN is at a value of "1". If the determination in step 70 is NO, the program returns to the main routine of FIG. 2 since such operations as will be described below are not necessary.

If, on the other hand, the determination of step 70 is in the affirmative, the routine proceeds to step 72, where it is determined whether the mode register MOD is at a value of "1", i.e., whether the current operation mode of the device is the fill-in standby mode. If the determination in step 72 is NO, this means that the current operation mode is the normal mode or fill-in mode.

With a determination of YES in step 72, the routine proceeds to step 74 to further determine, with reference to the count value of the tempo counter TCNT, whether the current timing within a measure falls one of first and second beats (in the case of quadruple time) or a first beat (in the case of triple time). If answered in the affirmative in step 74, the routine goes to step 76 in order to set the mode register MOD to "2" (indicating the fill-in mode). After step 76, the routine proceeds to step 78, where the contents of the address pointers $ADPNT_{0-4}$ are set to data of a beat next to the corresponding beat in a first measure of the fill-in patterns of the accompaniment patterns designated by the style number set, in the register STYL. As a result, an automatic accompaniment performance based on the fill-in patterns will be initiated at a beat next to the beat within the measure to which switch-on timing of the fill-in switch belongs. For instance, if the fill-in switch is turned on at a first beat within a given measure, a fill-in accompaniment performance will be initiated at a second beat within that measure.

If the determination in step 74 is in the negative, this means that the current timing within the measure (in-measure timing) falls a third or fourth beat (in the case of quadruple time) or a second or third beat (in the case of triple time), and then the routine moves to step 80 to set "2" into the mode register MOD. Then, the routine proceeds to step 82, where the contents of the address pointers $ADPNT_{0-4}$ are set to the leading or head data of the first measure of fill-in patterns for the accompaniment patterns that are designated by the style number set in the register STYL. As a result an automatic accompaniment performance based on the fill-in patterns will be initiated at the beginning of a measure next to the measure to which switch-on timing of the fill-in switch belongs. For instance, if the fill-in switch is turned on at a third beat within a given measure, a fill-in accompaniment performance will be initiated at the beginning of a measure next to the given measure.

If the determination is in the negative in step 72, or when the operation of step 78 has been completed, the routine proceeds to step 84 to set 0 into the part number register PART. Then, the routine goes to step 86, where a reproduction subroutine is carried out as will be described later with reference to FIG. 4. Next, after the register PART is incremented by one in step 88, it is determined in step 90 whether or not the current value of the register PART is 5, i.e., whether or not the reproduction processes for all the parts have been completed. If the routine has come to step 88 for the first time after step 84, then the current value of the register PART is 1, and thus the determination becomes negative in step 90.

With a determination of NO in step 90, the routine loops back to step 86 to repeat the operations of this and succeeding steps . When the reproduction processes for the zeroth to fourth parts have been completed, the value of the part register PART becomes 5 in step 88, so that the determination becomes affirmative in step 90. In such a case, the routine moves to step 92.

In step 92, the tempo counter TCNT is incremented by one. Then, the routine proceeds to step 94, where the counter TCNT is set to 0 if the value of the counter TCNT is 96 (in the case of quadruple time) or if the value of the counter TCNT is 72 (in the case of triple time). After that, the routine returns to the main routine of FIG. 2.

Figure 4:
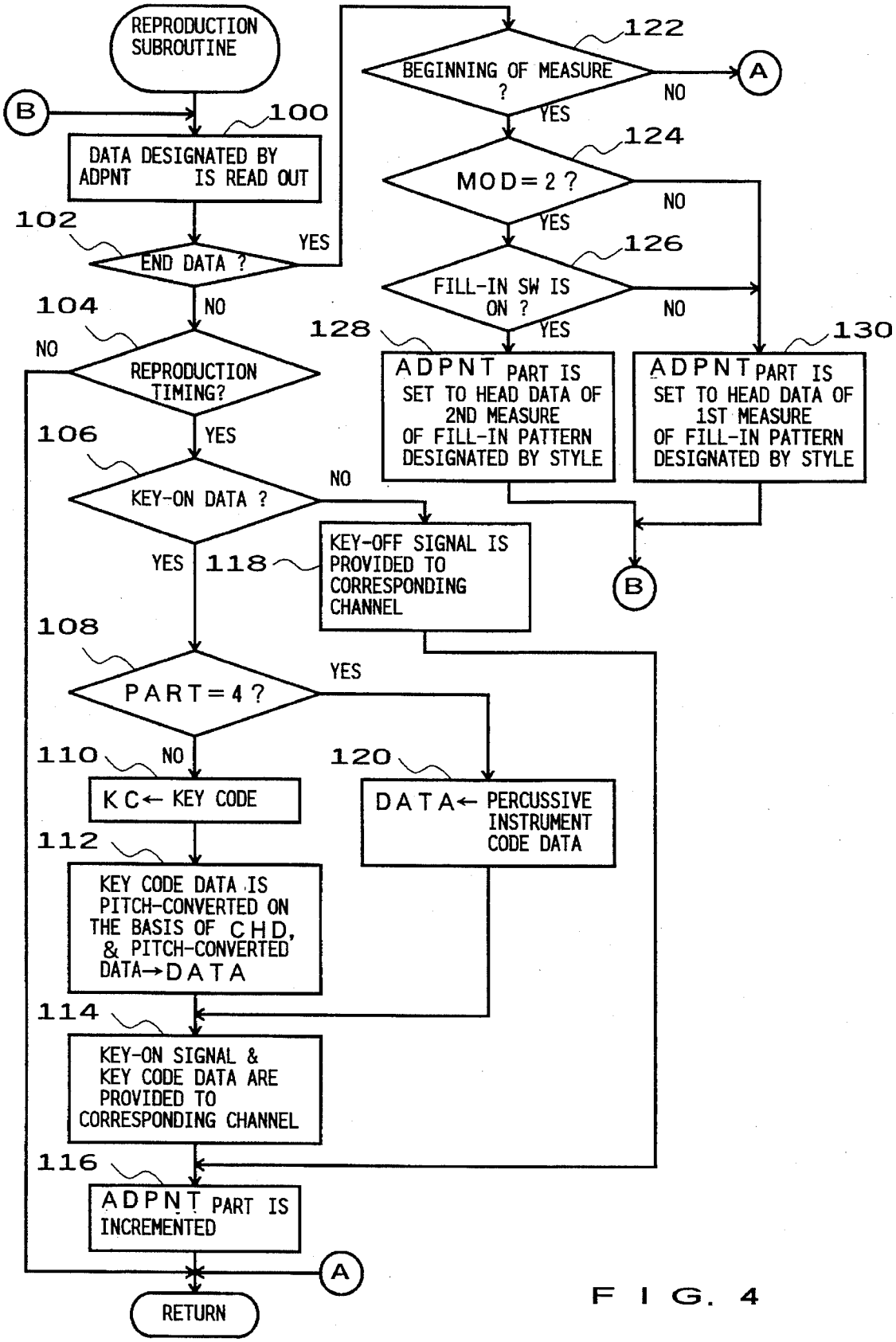
FIG. 4 is a flowchart of a reproduction subroutine of FIG. 3.

FIG. 4 shows the reproduction subroutine, where first in step 100, data designated by the address pointer $ADPNT_{PART}$ is read out from the accompaniment pattern memory 22. The subroutine then goes to step 102.

In step 102, it is determined whether the data read out from the memory 22 is end data. With a determination of NO, the subroutine goes to step 104, where it is determined whether the in-measure timing indicated by the read-out data is reproduction timing or not, by examining if the in-measure timing is coincident with the value of the counter TCNT. If the determination in step 104 is in the negative, the subroutine re-enters the interrupt routine of FIG. 3.

If the determination in step 104 is in the affirmative, then the subroutine proceeds to step 106, where a determination is made as to whether data next to the read-out timing data is key-on data (data indicative of a key-on event and a key code associated therewith). With a determination of YES, the subroutine moves to step 108 in order to determine whether the value of the part number register PART is 4 indicating the fourth part. If the determination is in the negative in step 108, this means that the value represents any one of the zeroth to third parts, and thus the routine step 110.

In step 110, the key code data contained in the key-on data is set into the key code register KC. After that, the subroutine proceeds to step 112, where the key code data subjected to a pitch is conversion process on the basis of chord data set in the chord register CHD, and then the pitch-converted key code data is set into the tone generation data register DATA. Then, the subroutine further moves to step 114.

In step 114, a key-on signal and the key code data set in the register DATA are provided to a channel of the tone generator 24 which corresponds to the part number of the register PART. For example, if the part number of the register PART is 0, a tone signal is generated via the zeroth channel.

After step 114, the address pointer $ADPNT_{PART}$ is incremented in step 116. Then, the subroutine re-enters the interrupt routine of FIG. 3, where the value of the part number register PART is incremented by one to become 1, for instance. Accordingly, the above-mentioned operations of steps 100 to 116 are performed for the first part. The same operations are also repeated for the second and third parts. In this manner, within one in-measure timing, tone signals for the zeroth to third parts can be generated simultaneously.

If the determination is in the negative in step 106, this means that the read-out data is key-off data, and the subroutine branches to step 118. In step 118, a key-off signal is provided to a channel of the tone generator 24 which corresponds to the part number set in the register PART so that a tone signal being generated via the channel is attenuated. After that, the subroutine moves to step 116.

If the determination is in the affirmative in step 108, this means that the value represents the rhythm-related fourth part, and the subroutine branches to step 120. For the fourth part accompaniment pattern, percussive instrument code data is prestored which is indicative of the name of one or more percussive instrument to be generated next to the timing data, so that in step 106, the percussive instrument code data is handled as key-off data in step 106. However, no data corresponding to the key-off data is present for the fourth part accompaniment pattern. In step 120, the percussive instrument code data is set into the tone generation data register DATA. Then, the subroutine moves to step 114.

In step 114, a key-on signal and the percussive instrument code data of the register DATA is provided to the fourth channel . As the result, one or more percussive tone signals are generated via the fourth channel. After that, the address pointer $ADPNT_4$ is incremented in step 116 and the interrupt routine of FIG. 3 is re-entered, so that the value of the register PART become 5 and thus an affirmative determination is obtained in step 90. Then, the interrupt routine returns to the main routine of FIG. 2 by way of steps 92 and 94.

If the determination is in the affirmative in step 102, this means that the accompaniment pattern corresponding to the address pointer $ADPNT_{PART}$ has come to an end, and so the reproduction subroutine goes to step 122. In step 122, it is determined, with reference to the count value of the tempo counter TCNT, whether the current timing is the head of a certain measure. With a determination of NO, the subroutine re-enters the interrupt routine of FIG. 3.

When the determination in step 122 has become affirmative, the subroutine proceeds to step 124, where a determination is made as to whether the mode register MODE is at a value of 2, i.e., whether the current operation mode is the fill-in mode. If the determination is in the affirmative in step 124, the subroutine proceeds to step 126 to further determine whether the fill-in switch is in the ON state. With a determination of YES in step 126, the subroutine proceeds to step 128.

In step 128, the address pointer $ADPNT_{PART}$ is set to the head data of a second measure of a fill-in pattern contained in the accompaniment pattern that is designated by the style number set in the register STYLE.

If the determination is in the negative in step 124 (i.e., if the current operation mode is the normal mode) , or if the determination is in the negative in step 126 (i.e., if the fill-in switch has not been maintained in the ON state), the subroutine branches to step 130. In step 130, the address pointer $ADPNT_{PART}$ is set to the head data of a first measure of a fill-in pattern contained in the accompaniment pattern that is designated by the style number set in the register STYLE.

Upon completion of step 128 or 130, the subroutine reverts to step 100 to read out the data designated by the address pointer $ADPNT_{PART}$. Then, the determination as to whether or not the read-out data is end data becomes affirmative, and thus the subroutine moves to step 104.

In step 104, it is examined whether the timing indicated by the read-out data coincides with measure head timing and also it is determined whether the timing is reproduction timing. After that, in accordance with the determination result, the operations subsequent to step 104 are performed in the above-mentioned manner.

The operation of step 128 allows a fill-in accompaniment performance to continue from the end of the fill-in pattern back to the head of the second measure, so that repetitive performance of the introductory portion is avoided.

Because of the operation of step 130, when a normal pattern has come to an end, it is possible to continue an automatic accompaniment performance by returning to the head of the first measure of the normal pattern; further, when a fill-in pattern has come to an end without the fill-in switch being continuously turned ON, it is also possible to continue an automatic accompaniment by returning to the head of the first measure of the normal pattern.

It should be appreciated that the above-described embodiment is only illustrative and various modifications are also possible without departing from the spirit of the present invention. For instance, in automatic accompaniment devices where an automatic accompaniment based on an introductory pattern is permitted prior to an automatic accompaniment based on a normal pattern, the introductory pattern may be repeated halfway in the middle of that pattern.

As has been described thus far, the present invention is characterized by being able to continue an automatic accompaniment by returning from the end of a particular accompaniment pattern back to a middle portion of that pattern. Therefore, it is possible to avoid repetitive performance of the introductory portion of the particular accompaniment pattern, thus achieving an automatic accompaniment performance free of musical unnatural feeling.

What is claimed is:

1. An automatic accompaniment device comprising:

storage means for storing a normal accompaniment pattern and a fill-in accompaniment pattern;

an operator for instructing an automatic accompaniment based on the fill-in accompaniment pattern;

automatic accompaniment means for performing an automatic accompaniment based on one of the normal and fill-in accompaniment patterns, said automatic accompaniment means, in response to actuation of said operator during the automatic accompaniment based on the normal accompaniment pattern, changing the automatic accompaniment over to the automatic accompaniment based on the fill-in accompaniment pattern:

end detection means for detecting an end of the automatic accompaniment based on the fill-in accompaniment pattern; and control means for, when the end of the automatic accompaniment based on the fill-in accompaniment pattern is detected by said end detection means, performing control such that the automatic accompaniment based on the fill-in accompaniment pattern is repeated from an intermediate portion thereof if said operator is being actuated and that the automatic accompaniment based on the fill-in accompaniment pattern is changed over to the automatic accompaniment based on the normal accompaniment pattern if said operator is not being actuated.

2. An automatic accompaniment device as defined in claim 1 wherein said fill-in accompaniment pattern comprises a pattern for plural measures, and said control means causes the automatic accompaniment based on the fill-in accompaniment pattern to be repeated from predetermined intermediate one of the plural measures.

3. An automatic accompaniment device as defined in claim 1 wherein said fill-in accompaniment pattern comprises a pattern for plural parts, and said control means causes the the automatic accompaniment based on the fill-in accompaniment pattern to be repeated for all the parts.

4. An automatic accompaniment device comprising:

storage means for storing a first accompaniment pattern and a second accompaniment pattern;

an operator for instructing an automatic accompaniment based on the second accompaniment pattern;

operation detection means for detecting actuation of said operator:

readout means for reading out one of said first and second accompaniment patterns;

end detection means for detecting that readout of the second accompaniment pattern has come to an end: and control means for, when said end detection means detects that the readout of the second accompaniment pattern has come to an end, performing control such that the readout of the second accompaniment pattern is resumed from an intermediate portion thereof if said operator is being actuated and that the readout of the second accompaniment pattern is changed over to readout of the first accompaniment pattern if said operator is not being actuated.

5. An automatic accompaniment device as defined in claim 4 wherein said second accompaniment pattern comprises a pattern for plural measures, and said control means causes the readout of the second automatic pattern to be resumed from predetermined intermediate one of the plural measures.

6. An automatic accompaniment device as defined in claim 4 wherein said second accompaniment pattern comprises a pattern for plural parts, and said control means causes the second accompaniment pattern to be repeated from an intermediate portion thereof for all the parts.

* * * * *